US007863818B2

(12) United States Patent
Aurongzeb

(10) Patent No.: US 7,863,818 B2
(45) Date of Patent: Jan. 4, 2011

(54) COIL/FOIL-ELECTRODE ASSEMBLY TO SUSTAIN HIGH OPERATING TEMPERATURE AND REDUCE SHALING

(75) Inventor: Deeder M Aurongzeb, Mayfield Heights, OH (US)

(73) Assignee: General Electric Company, Schenectady, NY (US)

( * ) Notice: Subject to any disclaimer, the term of this patent is extended or adjusted under 35 U.S.C. 154(b) by 627 days.

(21) Appl. No.: 11/832,230

(22) Filed: Aug. 1, 2007

(65) Prior Publication Data

US 2009/0033200 A1 Feb. 5, 2009

(51) Int. Cl.
*H01J 17/04* (2006.01)
*H01J 61/04* (2006.01)

(52) U.S. Cl. ..... 313/633; 313/623; 313/541; 313/637

(58) Field of Classification Search ..... 313/623, 313/626, 318.01
See application file for complete search history.

(56) References Cited

U.S. PATENT DOCUMENTS

| | | | | |
|---|---|---|---|---|
| 2,697,130 | A | 12/1954 | Korbelak | |
| 3,105,867 | A * | 10/1963 | Meijer | 313/318.07 |
| 3,420,944 | A | 1/1969 | Holcomb | |
| 5,021,711 | A | 6/1991 | Madden et al. | |
| 6,265,817 | B1 * | 7/2001 | Steinmann et al. | 313/332 |
| 6,384,533 | B1 | 5/2002 | Giesel et al. | |
| 2002/0008477 | A1 * | 1/2002 | Leichtfried et al. | 313/623 |
| 2003/0052608 | A1 * | 3/2003 | Morimoto et al. | 313/633 |
| 2005/0253521 | A1 * | 11/2005 | Scholl et al. | 313/626 |
| 2007/0262688 | A1 | 11/2007 | Aurongzeb | |

FOREIGN PATENT DOCUMENTS

| | | |
|---|---|---|
| DE | 38 12 084 A1 | 10/1989 |
| EP | 1 065 698 B1 | 1/2001 |

OTHER PUBLICATIONS

PCT/US2008/067265 International Search Report, mailed Oct. 1, 2008.

Kamata, et al., "Synthesis of titanium dioxide films by laser chemical vapor deposition (CVD)", *Nippon Sermikkusa Kyokai Gakujutsu Ronbunshi—Journal of the Ceramic Society of Japan*, Mar. 5, 1990, Abstract.

* cited by examiner

*Primary Examiner*—Sikha Roy
(74) *Attorney, Agent, or Firm*—Fay Sharpe LLP

(57) ABSTRACT

The invention relates to a barrier layer provided on the electrode assembly of a discharge lamp comprising at least a layer of nanoclusters of a non-oxidizing material. Further, the invention relates to an electrode assembly for a discharge lamp comprising an electrode having a foil attached thereto to create an electrode assembly, the assembly being coated with a multi-layer coating comprising at least a layer of non-oxidizing material in the form of nanoclusters, and at least another layer of non-oxidizing material, such that the total coating thickness is up to 1500 nm. A method to reduce thermal expansion mismatch between an electrode assembly and a discharge lamp envelope is also provided, the method comprising providing an electrode assembly and depositing on the surface of the assembly a coating having at least a nanocluster layer of a non-oxidizing material, and subsequently subjecting the lamp envelope in the electrode assembly area to pinching to create a pinch area, this lamp being able to operate at elevated temperature for extended periods, in excess of 1000 hours.

15 Claims, 3 Drawing Sheets

COIL/FOIL-ELECTRODE ASSEMBLY TO SUSTAIN HIGH OPERATING TEMPERATURE AND REDUCE SHALING

BACKGROUND OF THE INVENTION

The present disclosure relates to discharge lamps. It finds particular application with regard to high intensity quartz or ceramic discharge lamps that operate at elevated temperatures, and to the use therein of a non-oxidizing barrier layer on the foil and/or coil assembly of the lamp, and to devices exhibiting a metal and/or a nonmetal/semiconductor interface. However, it is to be appreciated that the present disclosure will have wide application throughout the lighting and related industries.

Generally known in the art are fluorescent and other discharge lamps. These lamps have a glass tube or light-transmissive envelope, usually with a circular cross-section. This envelope houses the lamp electrodes, a supporting fill gas, and various mercury components known in the art. The envelope may be hermetically sealed at both ends. The lamp electrodes are mounted in one or more bases, usually positioned at the ends of the envelope, these bases also functioning to seal the envelope. The electrodes coordinate to provide an arc discharge, and are formed of very small diameter wire, usually tungsten.

The electrode-pin assembly are by their physical structure and nature fragile. In addition, they are subject to additional stress during lamp manufacture and during lamp operation, particularly at elevated temperatures. Due to these factors, the electrode assembly of the lamp often includes a foil connector, which provides physical support for the fragile electrode and also functions to absorb some of the heat build-up of the electrode, thus reducing electrode operating temperature and consequently increasing lamp life.

As another means to provide support for the fragile electrode assembly, lamps often exhibit what is commonly referred to in the art as a "pinch portion" of the lamp. This portion of the lamp, located just next to the base at either end of the envelope, is characterized by a reduced diameter of the envelope or tube where the glass has been "pinched" close to the electrode. However, while this does increase the stability of the electrode assembly within the lamp structure, it also generates a potential problem with regard to the glass envelope coming into direct contact with the electrode wire, and compromising the performance thereof. One means of offsetting this problem has been to provide a coil around the electrode/foil assembly in the pinch area to serve as a barrier between the glass envelope and the electrode assembly.

In the lamp having the above general configuration, the coil/foil assembly is used to reduce stress caused by the thermal expansion mismatch between the quartz envelope and the metal electrode. Generally, the foil is a molybdenum foil, though other metals may be used. Even with the addition of the metal foil to the electrode assembly, the lamp continues to experience thermal expansion mismatch problems. For purposes of this disclosure, the term "foil" is meant to refer to any metal used to connect the electrode to the power source of the lamp, and unless otherwise noted, the terms "foil" and "foil/coil" or any combination thereof refer to the support assembly for the electrode(s).

In practice, the foil is welded to the electrode, for example a tungsten electrode, though other electrode materials may be used. The area of the weld is located in an area of the lamp known as the pinch, as is noted above, called this because the quartz envelope is actually "pinched" together as a means of supporting the foil/electrode connection. The weld may be further wrapped with a metal coil, or encased in a tube, to ensure that the quartz does not directly contact the electrode, and to stabilize the area of the foil/electrode weld.

This foil/coil assembly, even though it is intended to provide support for the electrode, may fail for several reasons. For example, the assembly may fail due to structural weakness, or to continued thermal mismatch of the assembly component materials. In some instances, failure of the assembly is avoided by coating the foil with chrome to reduce oxidation of the metal during lamp operation. Another means used to reduce failure due to excessive heat build-up is the use of a sandblasting technique to frost the envelope, which increases surface area and reduces pinch temperature. This practice is often used in entertainment lighting fixtures because this type of fixture runs the lamp base temperature to more than 400° C.

Regardless of the intended use of a lamp, most lamps include at least the foil/coil assembly in the noted pinch portion of the lamp. Because quartz, used to make many lamp envelopes, is an oxide material and the foil is generally formed from a metal, for example molybdenum, there remains an inherent thermal mismatch between the quartz and the foil, which is emphasized in the pinch area where the two materials are in very close proximity. This correlates to a stress point in the structure, which under normal or conventional operating conditions will eventually lead to lamp failure, but which is amplified under high operating temperature conditions resulting in early lamp failure. For example, under high temperature operating conditions, the pinch portion of the lamp may experience temperatures in excess of 500° C. Because the molybdenum foil oxidizes at around 500° C., within the first 400 hours of operation the foil suffers oxidation-generated degradation which leads to early lamp failure. Therefore, use of the conventional foil/coil electrode support in extended or long operating lamps, on the average of up to 1000 to 2000 operating hours, is not a viable option.

It will be appreciated by one skilled in the art, given the foregoing, that there remains a void in lamp technology with regard to high operating temperature lamps which do not suffer from early lamp failure, or shortened operating life. The problem to be addressed requires a solution which will not only eliminate the thermal mismatch between the metal foil and the quartz envelope in the pinch area, but which will also function to avoid early oxidation of the foil at high operating temperatures, thus allowing long lasting lamp performance, in excess of 1000 hours, even though the operating temperature of the lamp is in excess of 500° C.

BRIEF DESCRIPTION OF THE INVENTION

The invention relates to a barrier layer provided on the electrode assembly of a discharge lamp comprising at least a layer of nanoclusters of a non-oxidizing material. Further, the invention relates to an electrode assembly for a discharge lamp comprising an electrode having a foil attached thereto to create an electrode assembly, the assembly being coated with a multi-layer coating comprising at least a layer of non-oxidizing material having a thickness of less than 1 nm and in the form of nanoclusters, and at least another layer of non-oxidizing material, such that the total coating thickness is up to 1500 nm. A method to reduce thermal expansion mismatch between an electrode assembly and a discharge lamp envelope is also provided, the method comprising providing an electrode assembly and depositing on the surface of the assembly a coating having at least a nanoclusters layer of a non-oxidizing material, and subsequently subjecting the lamp envelope in the electrode assembly area to pinching to create a pinch area, this lamp being able to operate at elevated temperature for extended periods, in excess of 1000 hours.

DETAILED DESCRIPTION OF THE INVENTION

The invention relates to a coating for deposition on the foil/coil in the pinch area of a discharge lamp. More specifically, the invention relates to a coating that eliminates the problems caused by thermal mismatch between the quartz envelope and the foil/coil support assembly in the pinch portion of A discharge lamp. In addition, the coating has the capability to reduce or hinder the progression of oxidation of the metal foil sufficiently to extend operating life of the lamp to the desired 1000 to 2000 hours.

Figure 1:
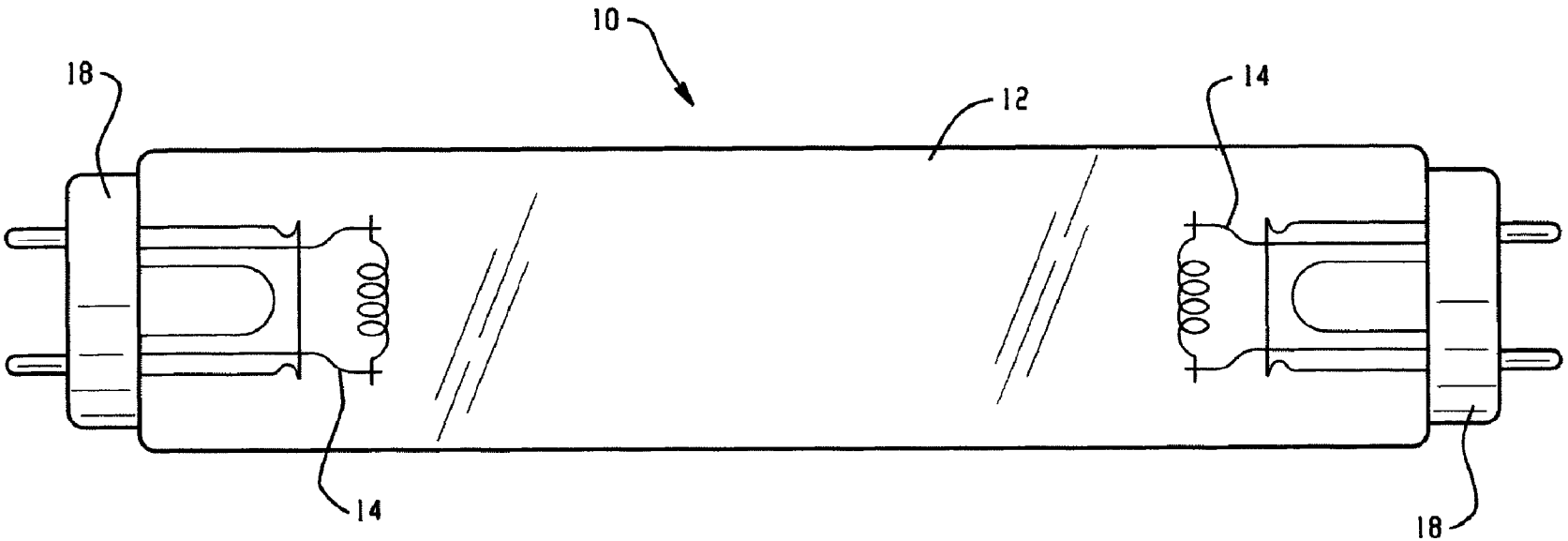
Fig. 1 PRIOR ART
FIG. 1 is a drawing of a conventional lamp assembly.
Figure 1A:
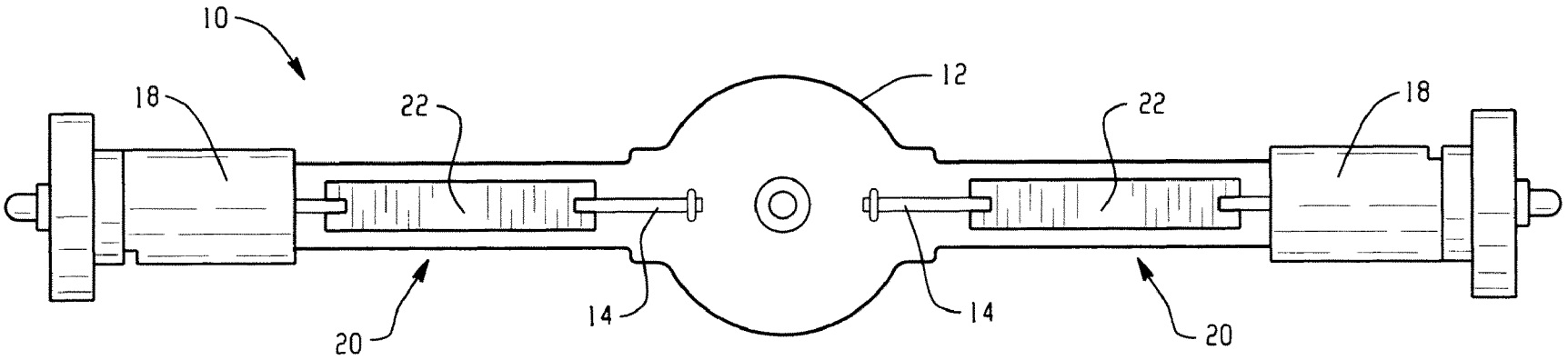
PRIOR ART Fig. 1a
FIG. 1*a* is a drawing of another conventional lamp assembly.

With reference to FIG. 1 or FIG. 1*a*, there is shown a representative discharge lamp 10, which is generally known in the art. The lamp 10 has a glass tube or light-transmissive envelope 12 which has a circular cross-section, and would include the conventional electrodes 14, fill gas 16, and mercury components (not shown) known in the art. The tube 12 is hermetically sealed at both ends by bases 18. The electrodes 14 are mounted in the bases 18, such that they sustain an arc discharge upon the application of power from a conventional lamp power source (not shown). Adjacent the base(s) 18 the lamp is configured to have a "pinch" area 20, where the quartz envelope diameter is constricted to provide support for the electrode assembly. FIG. 1*a* shows the foil 22 attached to electrode 14. All or any portion of the inner surface of the glass tube 12 may be coated with one or more coating layers (not shown), such as a transmissive barrier coating layer and/or a reflective barrier coating layer, of the type disclosed in U.S. Pat. No. 5,602,444, to our common assignee. It will be appreciated by those skilled in the art that though the invention is described herein with reference to this conventional lamp configuration, it will have application to any lamp structure with the potential to experience shortened lamp life due to thermal mismatch between the lamp envelope and the electrode assembly.

Figure 2:
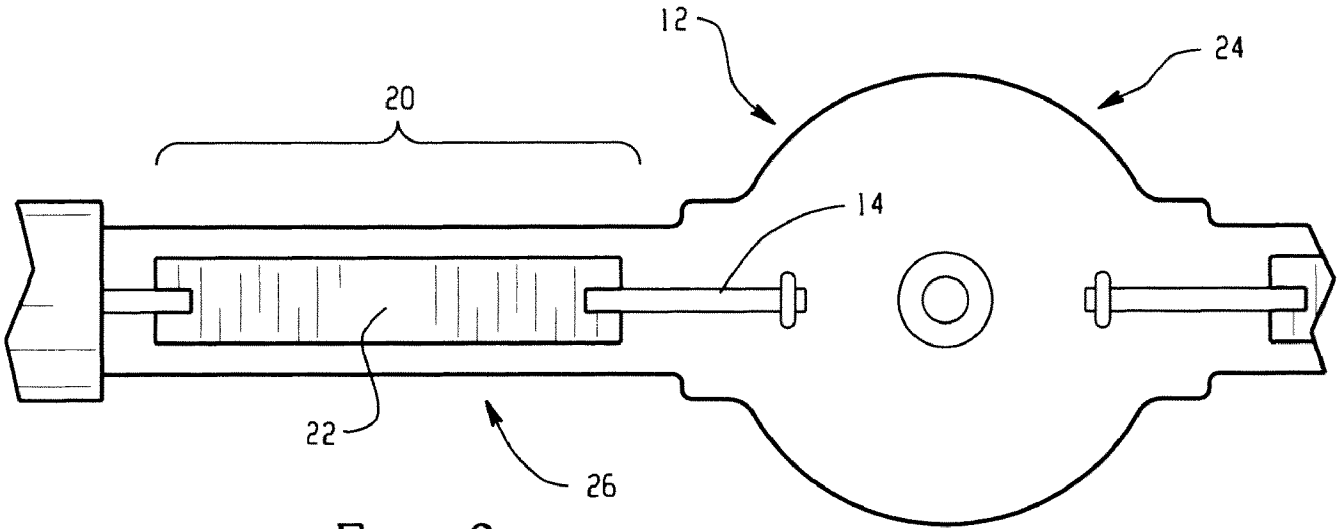
FIG. 2 is a drawing of the foil pinch area according to the invention.

FIG. 2 provides an expanded view of the pinch area 20 of a discharge lamp according to the invention. This corresponds to the type of lamp shown in FIG. 1*a*. As can be seen, foil 22 connects to electrode 14. The quartz envelope 12, while it is wider in region 24 representing the central portion of this type of lamp, is "pinched" in the area 26 of the electrode/foil connection, bringing the quartz into closer proximity with the electrode assembly than might otherwise be established. As has been stated, the pinch design is used to provide physical support for the electrode assembly.

With regard to the coating according to the invention, it may be interchangeably referred to herein as a "coating", "layer" or a "barrier" or any combination of these terms. The coating comprises at least a metal, such as for example a Ni—Mo—Cr composite, Re, Os, Au or Pt. These and other suitable metals for use as the coating according to the invention are characterized by a high melting point and low diffusion distance. The term "diffusion distance" refers to the distance traveled by an atom of a material, here a coating material, before it is trapped by atoms of the material into which it is diffusing. In addition to the metal as defined, the coating may comprise certain oxides, such as titanium oxide, zinc oxide, indium oxide, aluminum oxide, and composites such as TiInO, SrTiO, $LaSrTiO_3$, CuAlS. Therefore, the coating according to the invention comprises at least a conducting metal or a metal oxide, and may comprise a combination thereof. It is important for the coating to be conducting so that it does not interfere with operation of the lamp.

In addition to the foregoing metal and/or metal oxide, the coating may be doped to further enhance the performance thereof. Dopants may be selected from such materials as silicon, boron and carbon, which may be added as ions or in the elemental form by diffusing them into the coating composition at a very high temperature, after deposition of the coating.

The coating of the invention comprises several layers. The first layer of the coating is deposited at a thickness of about at least about 4/5 of a nanometer. This deposition may be accomplished by any known deposition technique. Preferably the layer is deposited at a temperature of at least about 400° C. Deposition at this temperature causes the barrier layer material to form a layer of nanoclusters of the material, as opposed to just a thin film of the nature deposited at lower temperatures, conventionally about 100° C. The thin layer of material deposited at this lower temperature undergoes at least partial diffusion of the metal of the coating into the metal foil. At the higher deposition temperatures according to the invention, however, the metal coating material does not diffuse into the foil or coil material, but rather is deposited as a coating of ultra hard nanoclusters, characterized by the fact that once deposited they remain substantially as an ultra hard surface layer, even when exposed to high temperature.

Figure 3:
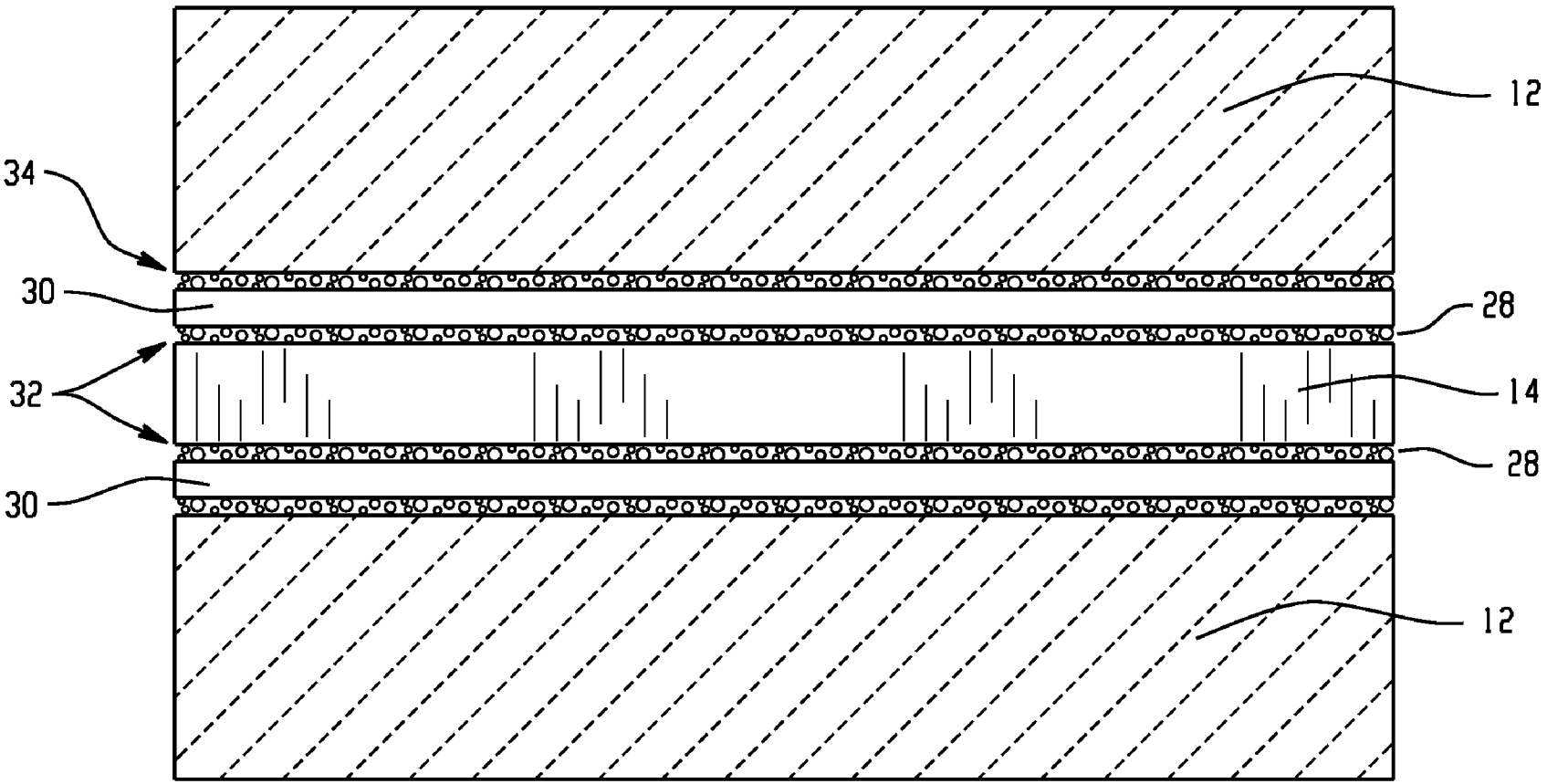
FIG. 3 is a drawing showing detail of the interface structure of the two coating layers according to the invention.

FIG. 3 sets forth a coated foil in cross section. It is seen in this figure that the first layer of the coating 28 resides on the surface of the metal foil in the form of the noted nanoclusters. In this figure, the second layer 30 is deposited in the form of a thin film corresponding to the oxide material referred to above. The coating further exhibits an interface 32 between the nanocluster layer and the thin film, and an interface 34 between the coating and the quartz envelope.

In that instance where the nanocluster coating layer comprises, for example Au, Ni, or Pt, it can be deposited by sputtering. This deposition process is then followed by annealing at about 400° C. for up to about 5 hours. The time necessary to deposit and anneal the coating is dependent on the coating thickness desired. The deposition temperature is determined by the metal content of the coating, i.e., metals with higher melting points require higher temperature deposition, or lower temperature deposition for a longer time period.

In that instance where the nanocluster coating layer is formed from, for example zinc, titanium oxide, indium oxide, or a sulfide or boride, the layer can be deposited by conventional chemical vapor deposition techniques. Generally, chemical vapor deposition is the deposition of a high-purity, high-performance coating by exposing the surface to be coated, in this case the foil assembly, to one or more volatile coating precursors. Activation and process conditions vary depending on the type of process used to initiate the chemical reaction, for example: operating pressure CVD, including but not limited to atmospheric pressure CVD, low-pressure CVD, and the like; vapor CVD, including but not limited to aerosol CVD, liquid injection CVD, and the like; plasma enhanced CVD; atomic layer CVD; hot wire CVD; metalorganic CVD; and others. One skilled in the art will know how to apply the desired technique depending on the substrate and the coating content.

The invention further includes the addition to the foregoing oxide layers of a dopant. The oxide materials may be coated with a very thin layer of silicon, boron or carbon, for example, to further reduce the thermal expansion mismatch between the quartz envelope and the material most closely adjacent or proximate thereto.

The size of the nanoclusters which comprise the coating described herein may vary. Generally, the clusters are larger as the layer of coating increases in thickness due to the fact that the clusters grow linearly with increased coating thickness.

After the initially deposited nanocluster coating layer, a second layer having a thickness of about 1500 nanometers is deposited. This secondary layer of the coating according to the invention may be formed from the same material as the initial layer, or may be formed from another metal composition. For example, the entire coating, including the initial and secondary or additional layers, may comprise Au or Ni—Mo—Cr, MoRe, MoOs, MoPt, for example. A coating comprising a mixture of components, for example the Ni—Mo—Cr coating, may exhibit better resistance to stress due to the fact that the mixed coating is likely to be more granular. While a single component coating is sufficient to block oxidation of the foil/electrode assembly, it may not resolve problems related to stress as efficiently as a mixed coating layer.

As is stated above, while a single component coating performs sufficiently in this regard, a coating comprising a combination of components may provide better results. Alternatively, the coating may comprise an initial gold nanocluster layer, for example, followed by an indium oxide/zinc oxide secondary layer. Further, either layer or both layers may be doped with, for example, silicon. It is further noted that by depositing an oxide containing material as the second layer of the coating, the coating can be made more susceptible to bonding of other materials. To illustrate then, for example, a nanocluster layer of metal, such as gold, may be deposited, followed by deposition of a second layer comprising TiInO. However, this ordering of layers is not necessary and the layers may be deposited in any order, i.e. metal or oxide/carbide/nitride first followed by the other. Both layers may be deposited using the same deposition technique, or different deposition processing may be employed.

Further, while the initial layer is preferably deposited as a nanocluster layer, the secondary or subsequent coating layer or layers may be deposited as a thicker nanocluster layer or as a thin film layer of the stated approximate thickness. Even where the latter thin film construction is used, the initial nanocluster layer provides a barrier against coating metal diffusion into the metal coil.

The multiple layer coating, comprising at least the initial deposition layer and the secondary deposition layer as provided herein, not only addresses the problem of thermal mismatch between the quartz or other lamp envelope and the electrode/foil assembly, but further functions to reduce oxidation of the molybdenum foil. In that instance where the coating layer is gold or platinum, because these metals do not oxidize, once the coating is deposited, there is no possibility that lamp failure will result from oxidative failure of the electrode assembly. If the coating layer is alternatively comprised of, for example, zinc or indium oxide, or any other material already in the oxide state, further oxidation is not possible or only negligible. Therefore, in either instance, the inventive nanocluster coating, including at least an initial nanocluster layer and a secondary layer, deposited onto the foil/coil assembly in the pinch area of the lamp protects the electrode and the foil/coil from oxidative failure, resulting in shortened lamp life. This is important, especially at higher operating temperatures, on the average of about 500° C. to 600° C. At elevated temperatures in this range, oxidation of the foil/electrode assembly occurs faster due to molybdenum diffusion and oxidation.

Before deposition of the coating, the surface of the foil can be etched to exhibit a roughness of greater than 100 nm. This etching process is used to enhance the adaptability of the foil to the quartz envelope. When the quartz envelope undergoes the pinch process, the quartz becomes soft and rough due to the temperature of the process. This creates two problems. First, the quartz is now rough in the area where it is being used to create a seal with the foil, which is smooth, making the creation of a good seal, which will completely control oxygen access to the electrode assembly, difficult. The second problem arises during lamp use as the quartz and foil experience thermal mismatch. Optimally, the foil would expand and contract with the quartz. Roughing the surface of the foil is one means to help avoid these problems. If the foil surface is made rough, as the quartz undergoes softening and roughening during the pinch process the roughened surfaces of the foil and the quartz can interlock to some degree, allowing a better seal and better movement of the foil with the quartz as it expands and contracts. Also roughening can be induced by deposition silica particle on molybdenum foil. However, even with a roughened foil surface, the seal may not be oxygen-tight and the foil may not exhibit the same movement due to the thermal mismatch of the materials. The coating herein addresses these issues by providing an enhanced seal between the foil and the quartz, and by providing enhanced slip. In addition, due to the coating composition, even if oxygen does leak into the electrode assembly area the non-oxidizing coating eliminates the possibility of the foil oxidizing. Further, the coating composition reduces the thermal mismatch between the foil and the quartz significantly.

The nanocluster coating layer offers yet a further advantage. The coating may also function as a dampening spring. This occurs as the quartz envelope begins to absorb heat generated by lamp operation. The stress of the heat deposited in the pinch area of the lamp, which in a conventional lamp lacking the nanocluster coating may result in envelope softening or electrode oxidative degradation, among other types of failure, is instead absorbed by the nanocluster coating layer. Absorption of this heat energy by the coating layer stabilizes the foil assembly, or provides a dampening effect with regard to the propagation of heat-generated degradation, thus stalling potential lamp failure.

Optionally, one or more additional layer(s) may be added during deposition of the coating. This additional layer or layers may have a thickness of up to about 5 nm. If added, this layer functions to provide further adaptability of the coating layer to the quartz, and can be formed of any of the oxides mentioned hereinabove and deposited by any known deposition technique.

In order to test the coating structure according to the disclosure, a lamp including a conventional molybdenum foil/electrode assembly was coated with a 10 nm Ni/Au nanocluster layer, deposited by sputtering, and over-coated with a $TiO_2$/Si oxide layer exhibiting a thickness of between 200-400 nm. Deposition of both layers was conducted using a sputtering deposition process, conducted at 300-400° C. The molybdenum foil/electrode assembly was brought to a temperature of 200° C. prior to the deposition of the coating and was maintained at this temperature until the doeposition chamber was evacuated, about 30 minutes after deposition. The coating was deposited at the rate of 2 A/sec. During deposition the substrate was constantly rotated at an angle of greater than 30 degrees to ensure uniform but rough coverage.

Once the coating process was completed, comparative testing was conducted in two manners. The first involved an oven test. The coated molybdenum foil/electrode assembly and an identical electrode assembly but in the uncoated state were placed in an open air oven, the temperature of which was raised to 600° C. At this temperature, simulating elevated operating temperature, the molybdenum foil coated as set forth above in accord with the disclosure herein exhibited no oxidative degradation after more than 50 hours. In comparison, the uncoated molybdenum foil failed after only 2 minutes at the elevated temperature, the failure being visually noticeable by the oxidation and cracking of the uncoated foil.

In a second test, the foils were subject to power cycling. Specifically, the foils, coated and uncoated, were subjected to 28 amp power, cycled through the foil at a rate of 30 cycles/day. This test regimen is comparable to operation of an actual lamp at 700° C. for 300 hours. After only 20 cycles, the uncoated foil failed and could no longer support the applied charge. The coated foil, in contrast, continued to support the applied charge through the entire test period, at the end of which time the coated foil exhibited only slight and almost no visible sign of degradation. Upon examination it was confirmed that the uncoated foil had experienced degradation at the molybdenum-oxide envelope interface during the pinch process, as evidenced by the presence of stress risers. FIG. 3 clearly shows the stress risers referred to. The coated electrode assembly, however, when examined after 50 hours of testing showed no sign of stress risers. Using a Polariscope to optically map the stress features present in the pinch area of the tested foils, it was determined that the uncoated foil assembly exhibited two times the stress experienced by the foil assembly coated according to the disclosure.

The foregoing results can be extrapolated to determine the effect the coating of the disclosure would have on the foil assembly during the pinch process and in operation. First, the results indicate the ability of the coating to remain adhesively bound to the foil assembly at operating temperatures in excess of 600° C. This is critical for use in certain lamp applications where elevated temperatures, in addition to accumulating heat energy cause lamps to fail early. This conclusion is supported by the lack of crack formation and oxidation on the coated assembly after testing. It is fully expected that the coating described herein will be suitable for use in any number of applications exhibiting potential for a thermal mismatch in a metal/ceramic system.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A barrier layer provided on the electrode assembly of a discharge lamp, the barrier layer comprising at least a first layer of nanoclusters of a non-oxidizing metal-containing material and a second layer selected from the group of oxides, nitrides, sulfides and borides.

2. The barrier layer according to claim 1 wherein the non-oxidizing metal-containing material is a metal.

3. The barrier layer according to claim 1 wherein the non-oxidizing metal-containing material is a metal oxide.

4. The barrier layer according to claim 1 wherein the non-oxidizing metal-containing material is a material selected from the group consisting of gold, silicon, platinum, rhenium, and osmium.

5. The barrier layer according to claim 1 wherein the non-oxidizing metal-containing material is a Ni—Mo—Cr composite material.

6. The barrier layer according to claim 1 wherein the barrier layer comprises more than two layers, at least one of the layers being a non-oxidizing metal-containing layer.

7. The barrier layer according to claim 6 wherein the barrier layer has a thickness of up to 1500 nm.

8. The barrier layer according to claim 7 wherein the more than two layers include one or more layers in addition to the first and second layers, said additional layers comprising non-oxidizing material.

9. The barrier layer according to claim 1 wherein the second layer is selected from $TiO_2$, $ZnO_2$, InO, $Al_2O_3$, TilnO, SrTiO, LaSrTiO, CuAlS, oxinitrides, carbon nitrides, sulfides, and borides.

10. An electrode assembly for a discharge lamp comprising an electrode having a foil attached thereto to create an electrode assembly, the assembly being coated with a multi-layer coating comprising at least a first coating layer of non-oxidizing metal-containing material having a thickness of not less than 4/5 nm deposited in the form of nanoclusters, and at least one additional layer of non-oxidizing material, such that the total coating thickness is up to 1500 nm.

11. The electrode assembly according to claim 10 wherein the first coating layer is deposited at a temperature of at least 400° C.

12. The electrode assembly according to claim 10 wherein the non-oxidizing metal-containing material is a metal or a metal oxide.

13. The electrode assembly according to claim 10 wherein the layers of the coating comprise the same material.

14. The electrode assembly according to claim 10 wherein the first coating layer is a metal and the second coating layer is an oxide.

15. A discharge lamp comprising the electrode assembly of claim 10.

* * * * *